US006971779B2

(12) United States Patent
Tau et al.

(10) Patent No.: US 6,971,779 B2
(45) Date of Patent: Dec. 6, 2005

(54) FIBER OPTIC AND LED FOUNTAIN AND METHOD

(75) Inventors: Shieh Yeuan Tau, Xiamen (CN); Wann Li, Xiamen (CN)

(73) Assignee: INTP, Inc., Ft. Lauderdale, FL (US)

( * ) Notice: Subject to any disclaimer, the term of this patent is extended or adjusted under 35 U.S.C. 154(b) by 85 days.

(21) Appl. No.: 10/738,541

(22) Filed: Dec. 17, 2003

(65) Prior Publication Data

US 2005/0135089 A1 Jun. 23, 2005

Related U.S. Application Data

(60) Provisional application No. 60/525,438, filed on Nov. 26, 2003.

(51) Int. Cl.[7] ..... F21V 7/04
(52) U.S. Cl. ..... 362/555; 362/565; 362/559
(58) Field of Search ..... 362/551, 555, 362/559, 565, 96, 101, 800, 806, 811; 40/406, 40/407, 439; 239/17–20, 23

(56) References Cited

U.S. PATENT DOCUMENTS 4,280,122 A * 7/1981 McKinley et al. ..... 340/815.43
4,807,092 A * 2/1989 Hasegawa ..... 362/565
5,165,778 A * 11/1992 Matthias et al. ..... 362/101
5,488,273 A * 1/1996 Chang ..... 318/16
5,493,618 A * 2/1996 Stevens et al. ..... 381/110
5,619,182 A * 4/1997 Robb ..... 340/479
6,241,362 B1 * 6/2001 Morrison ..... 362/231
6,279,835 B1 * 8/2001 Hansen ..... 239/20
6,334,270 B1 * 1/2002 Ko ..... 40/406

* cited by examiner

*Primary Examiner*—Sandra O'Shea
*Assistant Examiner*—Gunyoung T. Lee
(74) *Attorney, Agent, or Firm*—Robert C. Kain, Jr.; Fleit Kain

(57) ABSTRACT

The lighted table top water fountain includes a water bowl, a superstructure rising from the water bowl with a view area, overhead, a pump supplied with electrical power, and a water delivery system to carry water from the water bowl through the superstructure above the view area and drop the water into the view area. A plurality of light emitting diodes (LEDs) are mounted beneath the view area such that the waterfall is illuminated by the upwardly directed LEDs. A fiber optic light system is mounted between a scene board and a backboard, both of which are mounted at the rear of the superstructure behind the view area. Light generated from the fiber optics is emitted from said scene board into said view area and is reflected and refracted off of the waterfall. Optionally, an audio control turns ON and OFF the lights.

16 Claims, 4 Drawing Sheets

FIBER OPTIC AND LED FOUNTAIN AND METHOD

The present application is a regular patent application based upon and claiming the benefit of provisional patent application Ser. No. 60/525,438 filed Nov. 26, 2003.

The present invention relates to a fountain with fiber optic lights and LED (light emitting diode) lights. Additionally, the fiber optic and LED fountain is turned ON/OFF or switched into different operational modes (fountain ON/OFF, fiber optic ON/OFF and LED ON/OFF) based upon a human hand clap or other predetermined audio sound. A method of illuminating a table top fountain is also established.

BACKGROUND OF THE INVENTION

Table top fountains are known which incorporate LED lights directing multi-colored light upwards into a downwardly falling waterfall or stream. The light from these LEDs is reflected off the droplets of falling water towards the viewer. Additionally, the LED lights may cycle ON and OFF to achieve different color combinations for the table top water fall.

OBJECTS OF THE INVENTION

It is an object of the present invention to provide a table top fountain with fiber optic lit backdrop and an LED lighted waterfall.

It is an additional object of the present invention to provide an audio control for the LED and the fiber optic fountain.

SUMMARY OF THE INVENTION

The lighted table top water fountain includes a water bowl, a superstructure rising from the water bowl with a view area over said water bowl, a pump supplied with electrical power, and a water delivery system to carry water from said water bowl through said superstructure above the view area and drop the water into the view area. The lighted fountain a plurality of light emitting diodes (LEDs) mounted beneath the view area such that the waterfall is illuminated by the upwardly directed LEDs. A fiber optic light system is mounted between a scene board and a backboard, both of which are mounted at the rear of the superstructure behind the view area. Light generated from the fiber optics is emitted from said scene board into said view area and is reflected and refracted off of the waterfall. Optionally, an audio control turns ON and OFF the lights.

BRIEF DESCRIPTION OF THE DRAWINGS

Further objects and advantages of the present invention are set forth in the detailed description which follows, when taken in conjunction with the accompanying drawings in which.

DETAILED DESCRIPTION OF THE PREFERRED EMBODIMENTS

Figure 1:
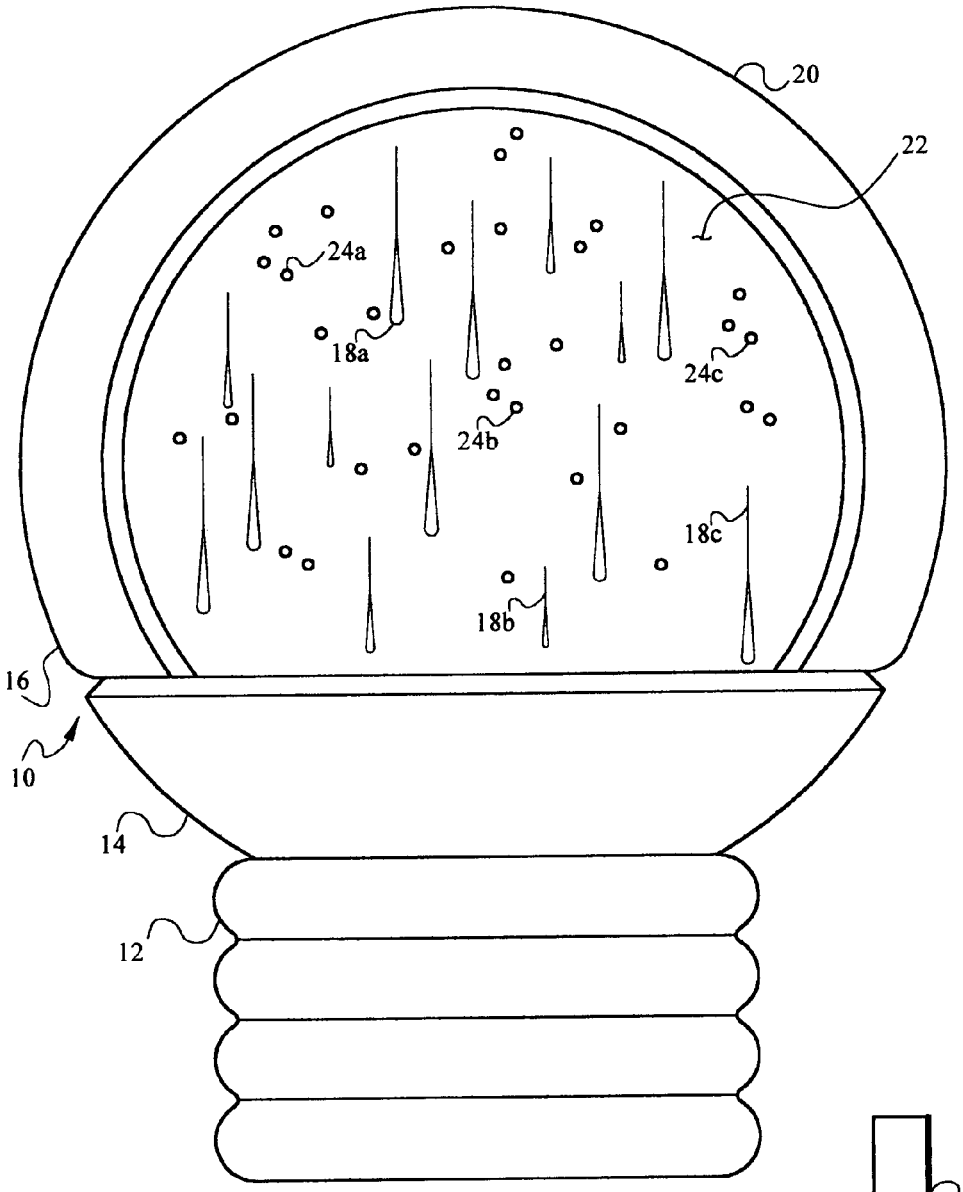
FIG. 1 diagrammatically illustrates the table top LED and fiber optic fountain of the present invention.

FIG. 1 diagrammatically illustrates table top fountain 10 having base 12, water bowl 14, and superstructure 16 mounted atop water bowl 14 and base 12. Water flow or water droplets 18*a*, 18*b* and 18*c* are dropping or dripping from upper region 20 of superstructure 16. The backside or rear of superstructure 16 includes a backboard (not shown) and a scene board 22. Water droplets 18*a, b* and *c* are generally laterally spaced apart or away from scene board 22. Scene board 22 has a plurality of holes or apertures 24*a*, 24*b*, 24*c* through which fiber optic generated light is emitted.

Figure 2:
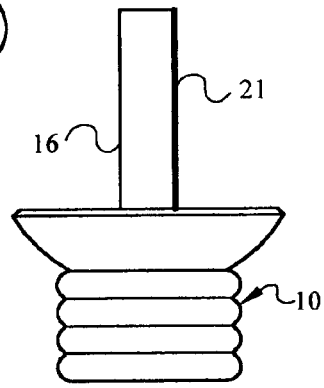
FIG. 2 diagrammatically illustrates a side view of the fountain of FIG. 1.

FIG. 2 diagrammatically illustrates a side elevational view of fountain 10. Backboard 21 is mounted at the backside or rear of superstructure 16. The scene board 22 (not shown in FIG. 2) is located at an intermediate portion in the superstructure. Fiber optic lights are mounted in the interspace between the backboard and the scene board such that, when illuminated, the fiber optic generated light passes through the holes in the scene board such that a viewer can see the multi-colored fiber optic light. Water droplets or water flow 18*a–c* are generated during operation at another intermediate lateral section of superstructure 16, that is, laterally spaced away from the scene board.

Figure 3:
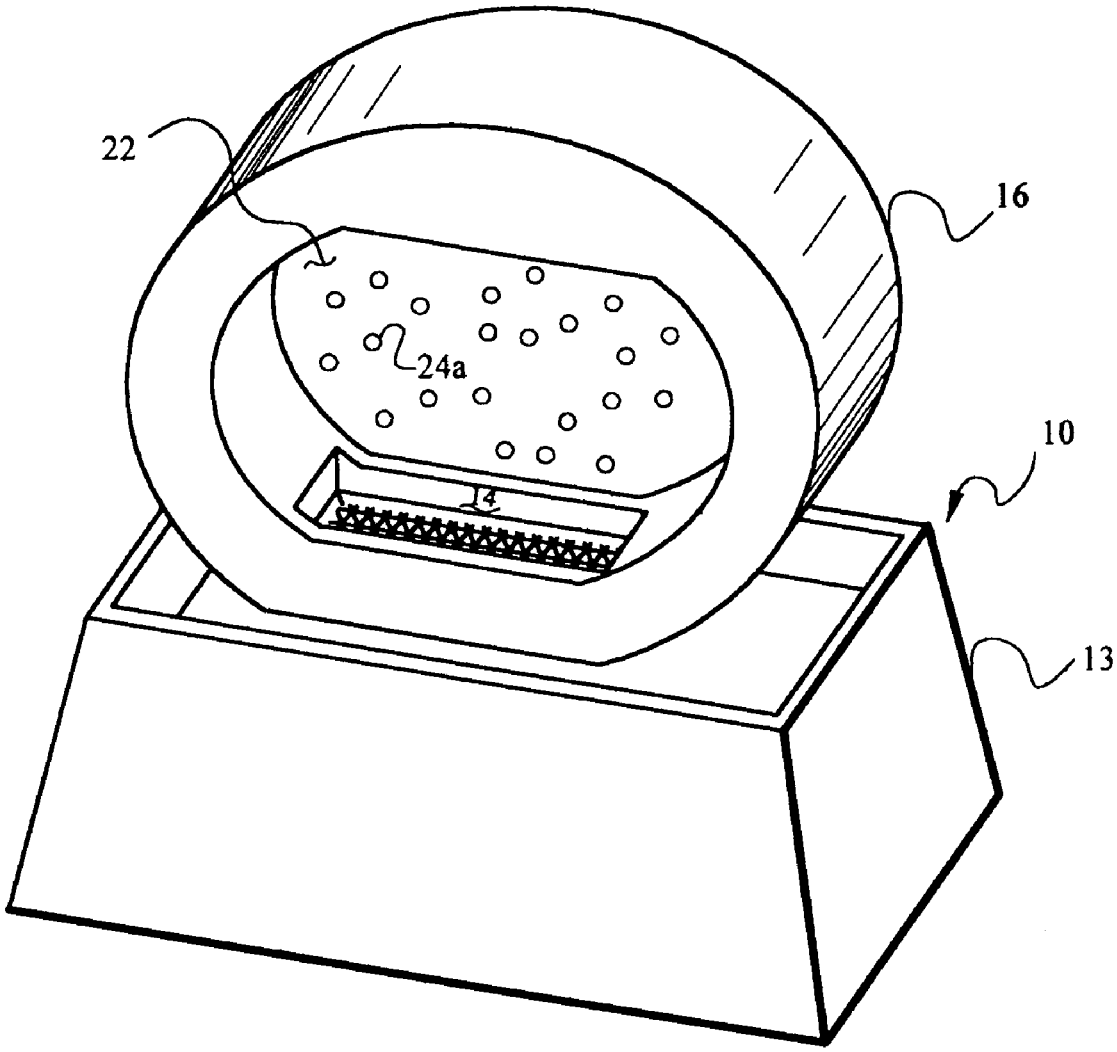
FIG. 3 diagrammatically illustrates a perspective view of the fountain in an OFF mode or condition.

FIG. 3 shows another fiber optic-LED fountain 10 with a different shaped base 13. Superstructure 16 includes, at its bottom, a water bowl 14. Scene board 22 includes a plurality of holes, one of which is hole 24*a*. It should be noted that the fiber optic-LED fountain, base, and superstructure 16 can be configured in to a variety of different ornamental designs.

Figure 4:
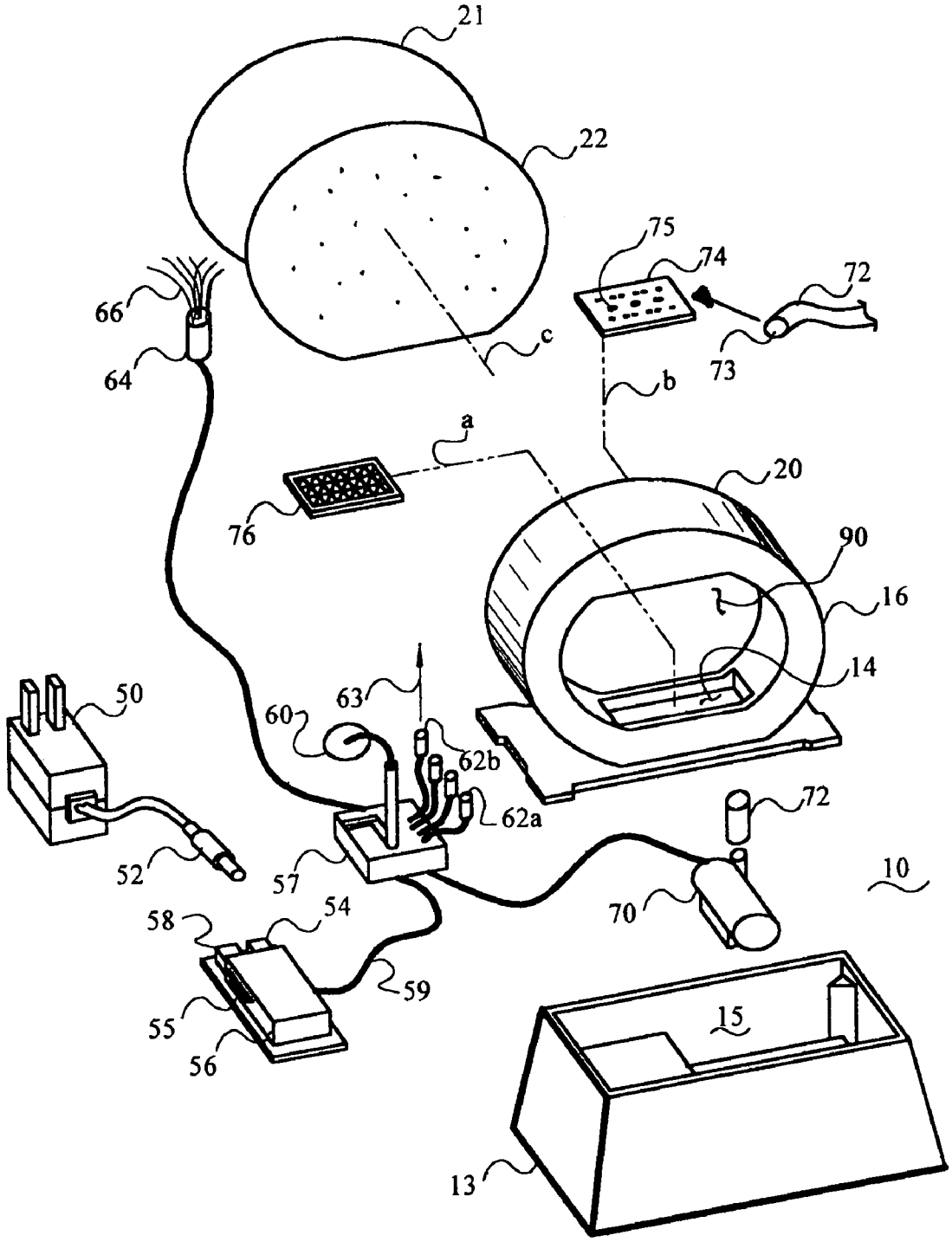
FIG. 4 diagrammatically illustrates the major operational components of the fountain (including the audio control, which may be omitted in certain embodiments); and, FIG. 5 shows a basic operational flow chart for one audio control sequence (other operational sequences may be utilized).

FIG. 4 diagrammatically illustrates the various components of the fiber optic-LED audio control or sound sensor fountain 10. It should be noted that the audio control maybe omitted from the system. The fountain can be powered either by AC power via adaptor 50 or maybe powered by battery 55 (designating one or more batteries). Additionally, battery 55 may be a rechargeable battery. Adaptor 50 is electrically connected to coupler plug 55 which mates and electronically connects with a mating coupler unit 54. Coupler 54 is mounted in a box 56 and the box can either hold battery 55 or additionally retain a conversion system to convert the electrical power to the proper voltage and amperage for the remainder of the circuitry. A global ON/OFF switch 58 is provided. Switch 58 is accessible to the user outside the shell base 13 since box 56 is mounted within and generally underneath base 13 of fountain 10. Electrical power from box 56 is supplied via line 59 to control circuit 57. If the system omits the audio control, components 60 and 57 are not utilized.

Audio control circuit 57 is further controlled by an audio sensor 60. Sensor 60 may sense various sharp sounds such as a hand clap, whistle, hoot voice tone, or hand clap according to factory pre-set conditions. Activation of sound sensor 60 changes the fiber optic ON/OFF, changes the LED ON/OFF and changes the fountain flow ON/OFF (dependent upon factory set operational modes) in addition to various combinations of the same. A plurality of LEDs 62*a, b* are connected to control circuit 57. In one embodiment, a bright white LED 62*a* is used in conjunction with a colored LED 62*b* and several other colored LEDs not numerically identified in FIG. 4. Control circuit 57 includes a subsequence control for said LEDs which sequentially turns ON and OFF different colored lights at different times. The LEDs are mounted beneath a screen in water bowl region 14 such that the light from the LEDs is emitted upward through the water bowl. When the LEDs are beneath the water bowl, light is emitted upward as shown by upward arrow 63. The upwardly directed light is subsequently reflected off droplets of water 18*a–c* which fall from the water works retained in the top portion 20 of super structure 16. Typically, LEDs 62*a, b* are mounted beneath a water screen discussed later. Circuit 57 may cycle various LEDs ON and OFF at certain times to change the color display of the fountain from white to blue to red to white, etc.

Control circuit 57 also is connected to a fiber optic light generator 64 which in turn is mechanically and optically connected to a plurality of fiber optic strands 66. Fiber optic strands 66 are mounted between backboard 21 and scene board 22. As discussed earlier in conjunction with FIGS. 1 and 3, scene board 22 has a plurality of holes 24*a–c* through which light is emitted or passes. The light is carried and generated by the fiber optic strands 66. Fiber optic generator 64 can illuminate all or portions of the fiber optic strands such that the light appears to change in various regions of the board as time passes. The fiber optic light maybe multi-colored. For example, the left region of scene board 22 may be illuminated at a different time compared with a mid-region and, at another time, a right region of scene board 22 may be illuminated. The fiber optic lights are typically subject to a subsequence light control to activate all or part of the fiber optic system at different times.

Regarding hydraulics, control circuit 57 is connected to a water pump 70. Water pump 70 is disposed in lower region 15 of base 13. Region 15 also defines a lower water bowl. Water from lower bowl region 14 is pumped via pump 70 through hose or tube 72 upwards vertically to the top of super structure 16 and the output of hose 70, that is output 73, is disposed over water disbursement plate 74. Disbursement plate 74 is mounted in the top region of superstructure 16 as shown by positional line b. Water disbursement plate 74 includes a plurality of holes, one of which is hole 75, such that water from hose output 73 flows over disbursement plate 74 and is more or less evenly disbursed throughout the top region 20 of super structure 16. The water, as it exits water disbursement plate 74, falls vertically downward through open region 90 of fountain 10. As discussed earlier, the upwardly directed light from LEDs 62*a, b*, is reflected off the water droplets 18*a–c* (FIG. 1) providing a unique visual appearance to the user. Water, after it passes through central open region 90 of the fountain, strikes wire net 76. Wire net or mesh 76 is disposed on a lip in the lower region of upper water bowl 14. Positional line a shows that wire net 76 is disposed in the upper water bowl 14. Positional line c indicates that scene board 22 and, by implication, fiber optic bundle 66 and back board 21, is mounted in the backside of superstructure 16.

Figure 5:
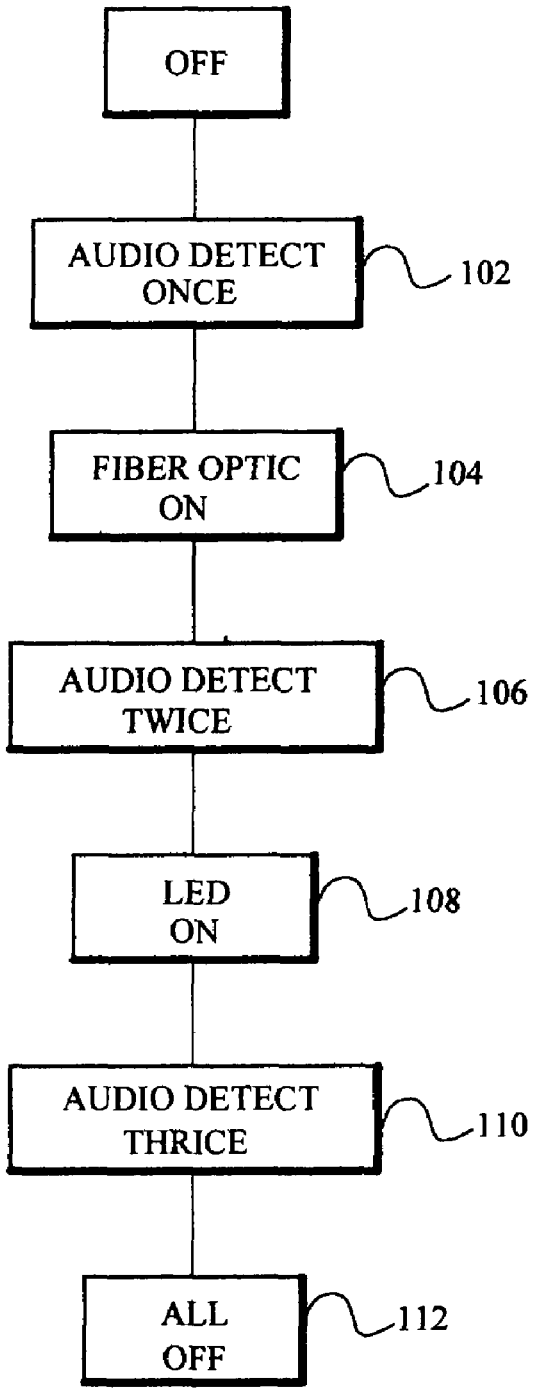

FIG. 5 diagrammatically illustrates one control flowchart for fountain. Other control routines may be used. In this embodiment, global switch 58 is activated ON thereby starting the water fountain and pump 70. Hence, water flows and falls through open region 90 of the superstructure 16 into upper water bowl 14 and eventually lower water bowl 15. Tube 70 recycles the water from pump 70 up to disbursement plate 74. Upon detection of a specific audio signal (clap, whistle, voice), the system detects the sound 102 and turns ON fiber optic systems 64, 66 as step 104. Upon the second audio detection 106, the control circuit 57 turns ON the LEDs 62*a, b* in step 108. Upon third detection 110 of the specific audio sound, the control system turns everything OFF 112. Of course, other sequential operations may be utilized. The water pump may also be subject to audio control.

The claims appended hereto are meant to cover modifications within the scope and spirit of the present invention.

What is claimed is:

1. A lighted table top water fountain comprising:

a water bowl, a superstructure with a view area there beneath and over said water bowl, a pump supplied with electrical power, a water delivery system adapted to carry water from said water bowl through said superstructure above said view area and drop said water into said view area, a plurality of light emitting diodes (LEDs) mounted beneath said view area emitting light directed upwards into said view area and into said water dropping into said view area;

a scene board mounted in said superstructure behind said view area;

a fiber optic light system mounted behind said scene board such that light generated therefrom is emitted laterally from said scene board into said view area wherein light is reflected and refracted by said water dropping into said viewing area both laterally and vertically due to the upwardly directed light and the laterally directed light; and electrical coupling system coupling said LEDs and said fiber optic light system to said electrical power.

2. A lighted table top fountain as claimed in claim 1 including an audio control interposed in said electrical coupling system for turning ON and OFF said LEDs and said fiber optic light system.

3. A lighted table top fountain as claimed in claim 2 wherein said audio control includes a sequential control which sequentially activates said LEDs and said fiber optic light system ON and OFF.

4. A lighted table top fountain as claimed in claim 1 including a backboard to sandwich said fiber optic light system between said backboard and said scene board.

5. A lighted table top fountain as claimed in claim 1 wherein said scene board has a plurality of apertures therethrough to permit passage of light.

6. A lighted table top fountain as claimed in claim 1 wherein said LEDs emit multiple colors of light.

7. A lighted table top fountain as claimed in claim 1 wherein said fiber optic light system emit multiple colors of light.

8. A lighted table top fountain as claimed in claim 7 wherein said LEDs emit multiple colors of light.

9. A lighted table top fountain as claimed in claim 8 including a first subsequence timed ON and OFF control for said LEDs and a second subsequence timed ON and OFF control for said fiber optic light system.

10. A lighted table top fountain as claimed in claim 9 including an audio control interposed in said electrical coupling system for turning ON and OFF said LEDs and said fiber optic light system.

11. A lighted table top fountain as claimed in claim 10 wherein said audio control includes a sequential control which sequentially activates said LEDs and said fiber optic light system ON and OFF.

12. A lighted table top fountain as claimed in claim 11 including a backboard to sandwich said fiber optic light system between said backboard and said scene board.

13. A lighted table top fountain as claimed in claim 12 wherein said scene board has a plurality of apertures therethrough to permit passage of light.

14. Method of illuminating a table top fountain waterfall comprising:

illuminating said waterfall with upwardly directly light from a plurality of light emitting diodes (LEDs) which light is transmitted directly upward into said waterfall thereby altering said light by refraction and reflection;

laterally illuminating said waterfall with laterally directed light from a fiber optic light system; and reflecting and refracting light from said upwardly directed LEDs through said waterfall and reflecting and refracting said laterally directed light from said fiber optic light system with said waterfall.

15. A method as claimed in claim 14 including illuminating said waterfall with different colored LED light and light from said fiber optic light system and sequentially turning ON and OFF said colored LED light and said light from said fiber optic light system.

16. A method as claimed in claim 15 including audibly controlling the LEDs and the fiber optic light system to turn ON and OFF the same.

* * * * *